US006910421B1

(12) United States Patent
Gethings et al.

(10) Patent No.: US 6,910,421 B1
(45) Date of Patent: Jun. 28, 2005

(54) GENERAL PURPOSE BOMBS

(75) Inventors: Bernard C. Gethings, Lancs (GB); Dennis J. Flynn, Manchester (GB); John A. Appleton, Wigan (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 08/160,835

(22) Filed: Dec. 1, 1993

(51) Int. Cl.[7] ..... F42B 12/16
(52) U.S. Cl. ..... 102/382; 102/476; 102/389
(58) Field of Search ..... 102/306–310, 102/382, 476, 389

(56) References Cited

U.S. PATENT DOCUMENTS

| | | | | | |
|---|---|---|---|---|---|
| 2,741,180 | A | * | 4/1956 | Meister | 102/476 |
| 2,804,823 | A | * | 9/1957 | Jablansky | 102/476 |
| 2,809,585 | A | * | 10/1957 | Moses | 102/476 |
| 3,077,834 | A | * | 2/1963 | Caldwell | 102/306 |
| 3,437,036 | A | * | 4/1969 | Franzer et al. | 102/476 |
| 3,732,816 | A | * | 5/1973 | Muller | 102/306 |
| 3,750,582 | A | * | 8/1973 | Kintish et al. | 102/476 |
| 4,063,512 | A | * | 12/1977 | Davis | 102/476 |
| 4,102,271 | A | * | 7/1978 | Bethmann | 102/476 |
| 4,714,022 | A | * | 12/1987 | Chaumeau et al. | 102/476 |
| 4,803,928 | A | * | 2/1989 | Kramer et al. | 102/476 |
| 4,967,666 | A | * | 11/1990 | Kellner et al. | 102/476 |
| 5,098,487 | A | * | 3/1992 | Brauer et al. | 102/307 |
| 5,111,746 | A | * | 5/1992 | Pentel et al. | 102/476 |
| 5,198,615 | A | * | 3/1993 | Robbie et al. | 102/476 |
| 5,303,654 | A | * | 4/1994 | Held | 102/476 |

FOREIGN PATENT DOCUMENTS

| | | | | |
|---|---|---|---|---|
| DE | 3341649 | * | 9/1989 | 102/476 |
| FR | 1002092 | * | 3/1952 | 102/476 |
| GB | 1 605 340 | | 1/1992 | |

* cited by examiner

*Primary Examiner*—Michael J. Carone
(74) *Attorney, Agent, or Firm*—Nixon & Vanderhye PLC.

(57) ABSTRACT

A general purpose bomb having a shaped charge penetrator warhead mounted in the front of the bomb and facing forward, in which the caliber of the warhead is at least 90% of the caliber of the general purpose bomb.

10 Claims, 1 Drawing Sheet

GENERAL PURPOSE BOMBS

BACKGROUND OF THE INVENTION

1. Field of the Invention

This invention relates to general purpose bombs. The general purpose bomb can be used to great effect against a variety of targets, depending upon its capabilities, and the nature of the target.

2. Discussion of the Prior Art

A principal use is against hard targets such as hardened aircraft shelters, bridge piers, aircraft runways, and the like. Against such hard targets the general purpose bomb is generally ineffective unless the bomb is able to penetrate into the target prior to detonation, so that the blast and heave effects on the target are maximised.

However, in modern warfare certain targets are extremely well protected. Hardened aircraft shelters may be protected by one or more meters of reinforced concrete which may be covered by a layer of soil or sand. Aircraft runways may be several meters thick. Tactical bunkers may be protected by several meters of reinforced concrete with mounded earth providing further protection.

Considerable effort has been devoted to the development of high penetration bombs capable of penetrating modern hard targets. These efforts have largely been directed towards the development of bombs designed to penetrate the target by virtue of their kinetic energy. This has led to long, thin designs having thick cases, which necessitates a reduction in the proportion of high explosive to about 20-25% of all-up weight. The terminal effect of the bomb is correspondingly reduced. Its penetration into the target is also critically dependent upon its velocity of impact, which in practice needs to be approaching Mach 1.0. This increases the difficulty of delivery.

It has been proposed in U.S. Pat. No. 4,488,487 to assist the penetration of a bomb dependent primarily on its kinetic energy, by the addition of some kind of small primary charge in the nose of the bomb. Such a charge might be a shaped charge. Its purpose is to condition the target material in the immediate impact area, so as to enable the bomb casing to penetrate slightly into the target, thus providing a toe-hold to counteract possible ricochet, especially at relatively low angles of incidence. The effectiveness of such designs has been limited, in that the small primary charges used have not been capable of conditioning a sufficient target volume to increase the initial penetration significantly.

In West German Patent No 2629280 there is disclosed a small tandem-charge munition, comprising a shaped-charge primary penetrator in a heavy metal casing, and a secondary charge. The overall caliber of the munition is 100 mm, and the secondary charge has a diameter of about one third of this. It is recognised that when the primary charge is detonated, it would have the effect of disrupting the secondary charge, and also that the rearward blast from the primary would cause the secondary charge to be driven away from the target.

Various special measures are described in order to counteract these effects, so that the secondary charge can be effectively emplaced within the target. These measures include the complication of a propelling charge and mechanism to ignite this charge at the correct instant to drive the secondary charge forward, against the blast from the primary charge.

West German Patent No 2829002 (to the same patentee) discloses another form of small-scale tandem warhead having primary and secondary charges of a comparable caliber. In this case it has been found necessary to provide mechanism for moving the primary and secondary shaped charge warheads longitudinally apart immediately prior to impact with the target in order to reduce the disruption of the secondary charge to an acceptable level.

SUMMARY OF THE INVENTION

The Applicant believes that such experience with small-scale warheads has precluded any serious consideration of taking a similar approach to the emplacement of a general purpose bomb within a hardened target. The Applicant has, however, generated a new concept and undertaken expensive trials which, against reasonable expectation, have demonstrated the natural prejudice against such an approach to be unfounded.

According to the present invention there is provided a munition comprising in combination a general purpose bomb and a penetrator warhead, the penetrator warhead being mounted at the forward end of the bomb, and comprising a forwardly-directed shaped charge, wherein the caliber of the penetrator warhead is least 90% of the caliber of the general purpose bomb.

As used herein the term "general purpose bomb" means a projectile comprising a mass of high explosive contained within a casing, and having an all-up weight not less than 300 lb (normally at least 500 lb), and being adapted for flight from a launch platform such as an aircraft to a target. Included within this definition are glide bombs with or without propulsion means, accelerated bombs, and free fall bombs, all of which may be guided or unguided.

Normally the general purpose bomb and the penetrator warhead will be generally cylindrical, and in this event the term "caliber" refers to the outer diameter in each instance. In any other instance the term refers to the maximum transverse dimension.

Preferably the caliber of the penetrator warhead is at least equal to that of the general purpose bomb. This will normally mean that the caliber is not less than about 10 inches.

In practice the caliber of the penetrator warhead will normally be not greater then 140% of that of the general purpose bomb. Greater calibers could lead to difficulties, for example in deployment from an aircraft, or in relation to the aerodynamics of the munition.

Normally the mass of the penetrator warhead will be in the range 20-40% of the overall mass of the munition, preferably 25-35%.

The term "shaped charge" as used herein means a charge of high explosive which is normally cylindrical in form, and has an axially symmetrical concave forward face which is lined with metal.

The shaped charge liner should preferably have a geometry such as on detonation to produce a high energy jet which is compact in the axial direction (i.e. has a relatively low velocity gradient through its length). The objective is to maximise the volume of the target which is denatured, structurally weakened or removed, so that the resistance to penetration by the general purpose bomb is as little as possible, across an area at least equal to the cross-section of the bomb.

A liner of generally hemispherical or part-spherical form has been found satisfactory for this purpose.

Liners which possess rotational symmetry but comprise different portions which are conical in form or parts of spheres having different or progressively varying radii, or have a substantially planar central zone may be suitable.

It can be advantageous to provide a liner which progressively increases in thickness from its periphery towards its center, so that for example the thickness at the center is between 1.5 and 2.5 times the minimum thickness at or near the periphery.

Any suitable liner material can be used. However aluminum is preferred. Advantageously, and contrary to normal practice, the liner may be of cast metal, especially cast aluminum.

BRIEF DESCRIPTION OF THE DRAWINGS

The invention will now be described by way of example only with reference to the accompanying drawings, in which.

DETAILED DESCRIPTION OF PREFERRED EMBODIMENTS

Figure 1:
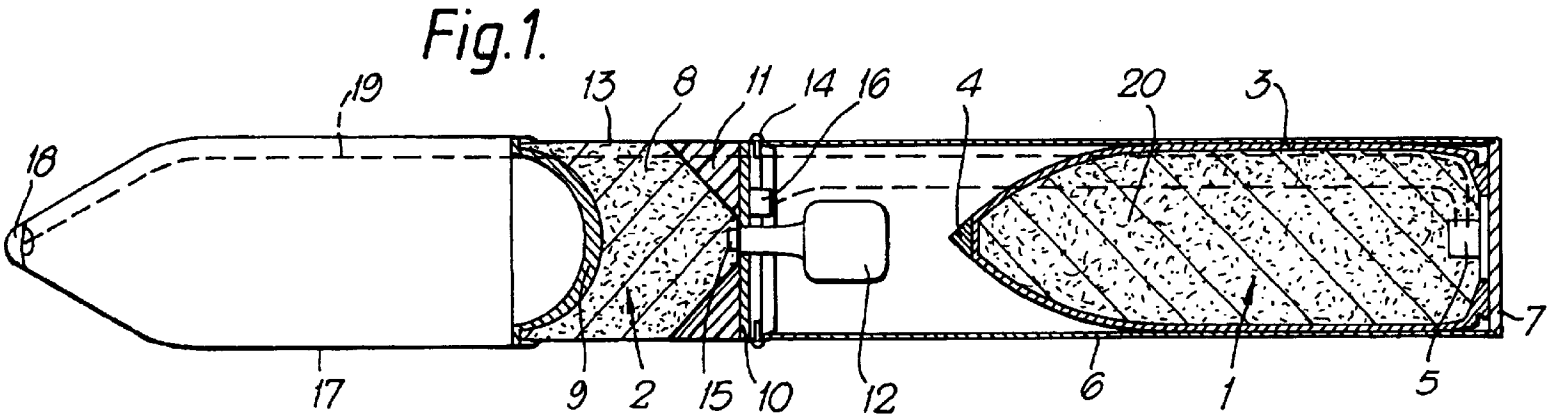
FIG. 1 shows in diagrammatic form a munition in accordance with the invention, incorporating a 1000 lb general purpose bomb, but wherein the tail unit is not shown.

As shown in FIG. 1, a munition in accordance with the present invention comprises a 1000 lb general purpose bomb 1 and a penetrator warhead 2 in the form of a hollow charge.

The general purpose bomb 1 comprises a fragmenting steel case 3 having a hardened nose portion 4 and a filling of high explosive such as Torpex. In the base of the bomb there is provided a suitable fuze 5. The steel case 3 has an outer diameter of approximately 16½ inches, and the bomb if as nominal all-up weight of 1000 lb. The bomb may be carried within a relatively light steel outer case 6 having an end closure plate 7 and an access opening 12 closed by a removable cover.

A tail unit (not shown) can be attached at the rear of the end plate 6, for giving stability and desired flight characteristics to the munition in flight.

The penetrator warhead 2 comprises a cylindrical body of high explosive 8 such as 60/40 RDX/TNT mixture. The forward face of the explosive charge 8 is concave, and is lined with a liner 9 of cast aluminum of substantially hemispherical form. The thickness of the liner varies progressively so that in the central region the thickness is approximately 1½ times that at the periphery. The design of liner is found on detonation to produce a high energy jet which is compact in form, having, for example, a velocity gradient not greater than 10% within 90% by mass of the jet.

More conventional designs such as conical liners having constant thickness can produce greater penetration into a target, but the cavity is long and narrow. The preferred form of shaped charge liner in the present invention is capable of denaturing a target of say concrete over a considerably wider area, albeit at the expense of some lost depth of penetration.

The rear face of the charge 8 is conical, having approximately a 45° cone angle. On detonation of the charge 8, the rearward blast therefore tends to be directed normally with respect to this rear face, so that the rearward blast effect on the bomb 1 is reduced substantially. In order to further minimise the effect of the rearward blast on the bomb 1, the rear of the charge 8 is separated longitudinally from the nose 4 by a distance equal to at least ⅓ of a charge diameter. A closure plate 10 is located to the rear of the charge 8. Light, inert material 11 such as foamed plastics fills the space between the rear of the charge 2, and the plate 10. The charge 2 is provided with a light metal casing 13, which is connected to the casing 6 by a weak connecting means 14 which is not capable of transmitting a significant mechanical impulse from the casing 13 to the casing 6. The charge 2 is provided with a central initiator 15 which can be activated via, for example, an electronic safety and arming circuit 16.

The diameter of the hollow charge 2 is approximately 18 inches, and its all-up mass is approximately 350 lb.

Forward of the hollow charge 2, the munition comprises a light aerodynamic fairing 17, eg of thin aluminum less than 2 mm thick. In the nose of the fairing there are provided one or more sensors 18, which may for example be sensitive to impact or proximity of a target, and produce an electrical signal in response thereto.

The electrical signal generated by the sensor or sensors 18 is transmitted via an electrical connector 19 to the fuze 5, which can transmit a signal to the safety and arming unit 16 via a second electrical connector 20.

In use the munition would include a tail unit (not shown) and would be provided with lugs (not shown) to permit carriage beneath and release from an aircraft. In order to attack a selected target, the munition would be released at the appropriate stand-off and altitude, from an aircraft travelling at a velocity which might be as low as Mach 0.7. Accuracy of targeting is rendered easier at lower aircraft velocity.

The munition then drops to the target in free-fall, and may reach the target with a residual velocity of say Mach 0.55. The kinetic energy of the munition at this velocity is of the order of 10 Megajoules or less. By comparison, the chemical energy available in the penetrator charge for conditioning the target is at least eight times this value, and probably exceeds 100 Megajoules.

On engagement with the target, the appropriate sensor 18 sends a signal to the fuze 5 via line 19. The fuze 5 processes this signal, and generates a further signal which is sent via the line 20, and safety and arming unit 16 to activate the initiator 15 and hence the penetrator charge 2. Because of its special design, the charge 2 converts the liner 9 into a compact high energy jet which meets little resistance from the lightweight ogive. If the target is of concrete, or similar material, possible covered with a deep layer of soil, the high energy jet will cause removal of the target material over a cross-sectional area which is at least as great as the cross-section of the bomb 1, and denaturing to a greater depth. The rearward blast created by the charge 8 has relatively little effect on the forward velocity of the bomb 1, which therefore continues under its own inertia to penetrate a substantial distance into the target. Because target material has been removed and/or the cohesion of the target material has been destroyed over a substantial area, the target material offers little resistance to penetration.

The hollow charge 2 is mechanically decoupled from the bomb 1 and the delicate fuzing and other mechanism associated with the bomb 1, by the weak connection 14. The functioning of the bomb 1 will thus not be impaired by the transfer of a significant mechanical impulse via casings 13 and 6.

Following penetration by the bomb, the fuze 5 generates another signal to initiate the bomb itself at an appropriate instant. The bomb 1 is thus emplaced in the most effective position, within the target material or inside a targeted hardened shelter, and produces the maximum destructive effect.

The increased lethal effect of a munition in accordance with the invention stems at least in part from the very high proportion of high explosive which it enables to be effectively deployed against the target. For example, the current generation of free fall or guided bombs adopts a high terminal velocity, a hardened thick case, and a long thin geometry, with the aim of penetrating deep into the target by virtue of its kinetic energy. These designs are capable of delivery of only about 20% or so by weight of high explosive to the target area. Conventional general purpose bombs deliver perhaps 40% by weight of high explosive. Even the current generation is generally incapable of penetrating a considerable proportion of hardened aircraft shelters, tactical bunkers, etc which are very highly protected.

By contrast, a munition in accordance with the present invention can deliver typically 45% of total weight in high explosive, effectively directed against the target, and is capable of defeating even highly fortified tactical bunkers.

Because of this, munitions in accordance with the present invention are far less sensitive to their terminal velocity at the target. For example, a reduction in velocity from Mach 0.9 to Mach 0.55 would reduce the energy available for initial target penetration by about 60% in the case of the current generation, but by only about 10% in the case of the present invention.

Figure 2:
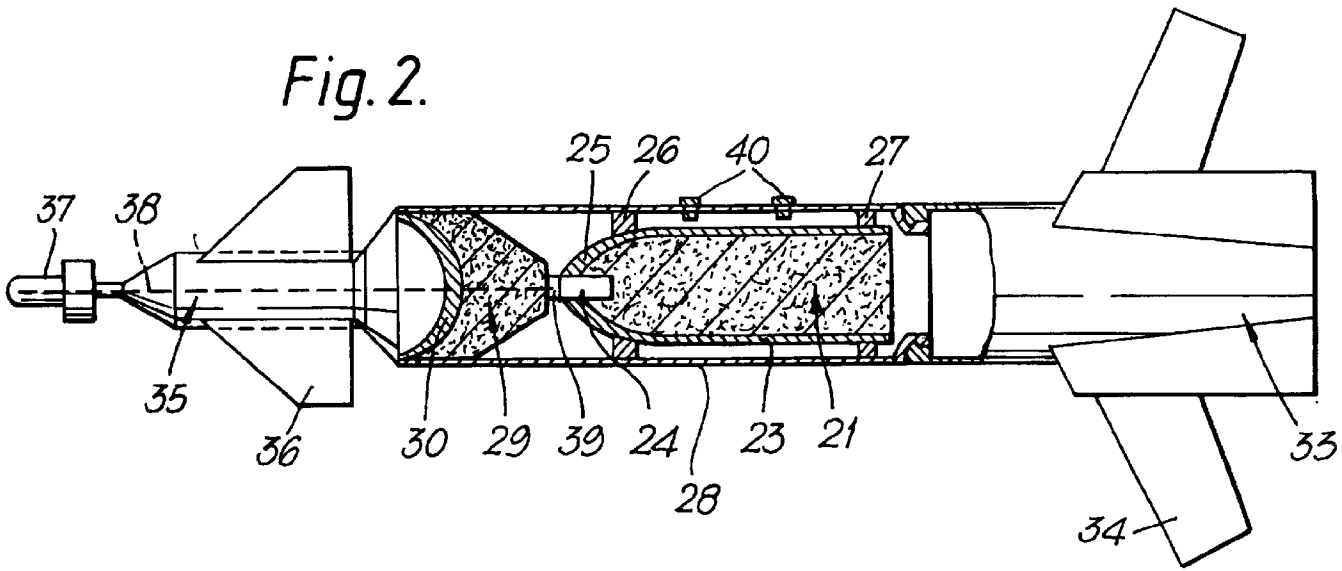
FIG. 2 shows in diagrammatic form an alternative design of munition in accordance with the invention incorporating a 540 lb bomb, and including guidance means and a tail unit.

As shown in FIG. 2, another form of munition in accordance with the invention comprises a general purpose bomb 21 and a penetration warhead 22. In this embodiment the bomb 21 has a cylindrical steel case 23 with a fuzing and detonation device 24 in an ogival nose region 25 and the case 23 is thickened in this region to aid penetration.

The bomb 21 has a nominal all-up weight of 540 lb, and is supported in an outer casing 28 by supports 26, 27. The case 23 contains a cast filling of Torpex high explosive, and the external diameter of the case is approximately 12½ inches.

The penetrator warhead is generally cylindrical in form and comprises an explosive charge 29 having a hollow front face lined with an aluminum liner 30. The charge 29 may be of 60/40 RDX/TNT mixture, and the liner is of substantially hemispherical form, similar to the liner 9 of FIG. 1. On detonation of the charge 29, the liner 30 is formed into a compact high energy penetrating jet.

The penetrator warhead is encased by the outer casing 28, and thus has an outer diameter (including the casing) of about 15 inches.

The munition in this embodiment is provided with a passive tail unit 33, having fixed fins 34. In addition the munition is provided with an active guidance unit 35 at its forward end. The unit 35 is provided with controllable fins 36, which can actively guide the munition towards a selected target.

In front of the guidance unit 35 there is provided a target sensor 37 which can operate as an impact sensor or a proximity sensor. When the target is sensed, the sensor 37 sends a signal via electrical connector 38 to a safety, arming and fuzing unit 39. On receipt of the signal, the unit 39 first initiates the shaped charge 22. This results in removal and conditioning of the target area in a similar manner to that of the first embodiment. The bomb 21 thus enters into the conditioned area of the target and is deeply emplaced therein. At an appropriate moment thereafter, the bomb 21 is initiated by the unit 39. Lugs 40 are provided, by means of which the munition can be carried below an aircraft.

What is claimed is:

1. A munition comprising in combination:

a general purpose bomb having a weight not less than 300 pounds, for flight from a launch platform to a target; and a penetrator warhead, the penetrator warhead being mounted forwardly of the bomb, and comprising a forwardly-directed shaped charge, wherein the caliber of the penetrator warhead is at least about 90% of the caliber of the general purpose bomb.

2. A munition according to claim 1 wherein the caliber of the penetrator warhead is at least about equal to that of the general purpose bomb.

3. A munition according to claim 1 wherein the caliber of the penetrator warhead is not less than about 10 inches.

4. A munition according to claim 1 wherein the caliber of the penetrator warhead is not greater than about 140% of that of the general purpose bomb.

5. A munition according to claim 1 wherein the mass of the penetrator warhead is in the approximate range 20 to 40% of the overall mass of the munition.

6. A munition according to claim 1 wherein the shaped charge has a liner of one of hemispherical and part-spherical form.

7. A munition according to claim 1 wherein the shaped charge has a liner which progressively increases in thickness from its periphery towards its center.

8. A munition according to claim 7 wherein the shaped charge liner has a thickness at its center which is between about 1.5 and 2.5 times the minimum thickness near the periphery.

9. A munition according to claim 1 wherein the shaped charge has a liner of one of aluminum and aluminum alloy.

10. A munition accordingly to claim 1 wherein the liner is of cast metal.

* * * * *

UNITED STATES PATENT AND TRADEMARK OFFICE

CERTIFICATE OF CORRECTION

PATENT NO. : 6,910,421 B1
DATED : June 28, 2005
INVENTOR(S) : Gethings et al.

It is certified that error appears in the above-identified patent and that said Letters Patent is hereby corrected as shown below:

Title page,
Item [30], Foreign Application Priority Data, please add:
-- Dec. 8, 1992 (GB) 9225589 --.

Signed and Sealed this

Twenty-second Day of November, 2005

JON W. DUDAS
*Director of the United States Patent and Trademark Office*